US005948747A

United States Patent [19]

Schambil et al.

[11] Patent Number: 5,948,747

[45] Date of Patent: Sep. 7, 1999

[54] SPRAY-DRIED DETERGENT OR A COMPONENT THEREFOR

[75] Inventors: Fred Schambil; Wolfram Linke, both of Monheim; Hubert Freese, Duesseldorf, all of Germany

[73] Assignee: Henkel Kommanditgesellschaft auf Aktien

[21] Appl. No.: 08/860,890

[22] PCT Filed: Dec. 22, 1995

[86] PCT No.: PCT/EP95/05092

§ 371 Date: Aug. 11, 1997

§ 102(e) Date: Aug. 11, 1997

[87] PCT Pub. No.: WO96/21713

PCT Pub. Date: Jul. 18, 1996

[30] Foreign Application Priority Data

Jan. 12, 1995 [DE] Germany ..... 195 00 644

[51] Int. Cl.[6] ..... C11D 17/00; C11D 3/10; D06L 1/00

[52] U.S. Cl. ..... 510/443; 510/276; 510/351; 510/356; 510/452; 510/507; 510/509; 8/137

[58] Field of Search ..... 510/443, 452, 510/276, 351, 507, 356, 509, 511, 137

[56] References Cited

U.S. PATENT DOCUMENTS

| | | | |
|---|---|---|---|
| 3,886,098 | 5/1975 | Disalud et al. | 510/326 |
| 4,264,464 | 4/1981 | Gangwisch et al. | 510/323 |
| 4,664,839 | 5/1987 | Rieck | 252/175 |
| 4,707,290 | 11/1987 | Seiter et al. | 252/140 |
| 4,816,553 | 3/1989 | Baur et al. | 528/245 |
| 4,818,424 | 4/1989 | Evans et al. | 510/443 |
| 4,820,439 | 4/1989 | Rieck | 252/135 |
| 4,849,125 | 7/1989 | Seiter et al. | 252/109 |
| 5,030,379 | 7/1991 | Knight et al. | 510/443 |
| 5,139,693 | 8/1992 | Wilms et al. | 510/443 |
| 5,151,208 | 9/1992 | Huijben et al. | 510/452 |
| 5,494,488 | 2/1996 | Arnoldi et al. | 8/137 |
| 5,501,810 | 3/1996 | Eugster et al. | 510/443 |
| 5,501,814 | 3/1996 | Engelskirchen et al. | 252/174.17 |
| 5,541,316 | 7/1996 | Engelskirchen et al. | 510/471 |
| 5,565,422 | 10/1996 | Del Greco et al. | 510/443 |
| 5,580,941 | 12/1996 | Krause et al. | 527/300 |
| 5,756,445 | 5/1998 | Dorset et al. | 510/357 |

FOREIGN PATENT DOCUMENTS

| | | |
|---|---|---|
| 394 203 | 2/1992 | Austria . |
| 142 910 | 5/1985 | European Pat. Off. . |
| 0 149 264 | 7/1985 | European Pat. Off. . |
| 164 514 | 12/1985 | European Pat. Off. . |
| 280 223 | 8/1988 | European Pat. Off. . |
| 0 360 330 | 3/1990 | European Pat. Off. . |
| 525 239 | 2/1993 | European Pat. Off. . |
| 34 44 960 | 6/1986 | Germany . |
| 35 45 947 | 7/1987 | Germany . |
| 39 36 405 | 5/1991 | Germany . |
| 42 21 381 | 2/1994 | Germany . |
| 43 00 772 | 7/1994 | Germany . |
| 43 03 320 | 8/1994 | Germany . |
| 43 32 373 | 3/1995 | Germany . |
| 43 33 224 | 4/1995 | Germany . |
| 44 17 734 | 11/1995 | Germany . |
| WO 93/08251 | 4/1993 | WIPO . |
| WO 93/16110 | 8/1993 | WIPO . |

*Primary Examiner*—Lorna Douyon

*Attorney, Agent, or Firm*—Ernest G. Szoke; Wayne C. Jaeschke; Real J. Grandmaison

[57] ABSTRACT

A spray-dried particulate detergent composition containing a) 3% to 20% by weight of anionic surfactant, b) 0 to 2% by weight of nonionic surfactant, c) 20% to 65% by weight of inorganic builders, based on water-free active substance, selected from carbonates, hydrogen carbonates and silicate-based builders, and d) 0 to 25% by weight of neutral salts, based on the weight of the spray-dried composition, wherein the spray-dried composition has been aftertreated with nonionic surfactant. The composition has favorable dispensing and solubility properties.

7 Claims, No Drawings

SPRAY-DRIED DETERGENT OR A COMPONENT THEREFOR

BACKGROUND OF THE INVENTION

1. Field of the Invention

This invention relates to a spray-dried detergent or to a component therefor, the spray-dried detergent or the component therefor showing favorable dispensing behavior and favorable solubility behavior. The present invention also relates to a washing process in which the spray-dried detergent is dispensed from a dispensing compartment into a commercial washing machine.

2. Discussion of Related Art

Nonionic surfactants are known to exhibit very high cleaning power which makes them particularly suitable for use at washing temperatures of 60° C. or lower. Depending on their hydrophilicity, however, nonionic surfactants can only be processed by spray drying in certain quantities because, otherwise, excessive pluming occurs in the waste air of the spray drying towers and the spray-dried powder is left with unsatisfactory flow properties. In addition, when incorporated in the slurry, they undesirably increase its viscosity where anionic surfactants are simultaneously present. Accordingly, processes have been developed in which the liquid or molten nonionic surfactant is mixed with the particles spray-dried beforehand or is sprayed onto a carrier substance. According to European patent application EP-A-0 360 330, for example, mixtures of nonionic surfactants and fatty acids are spayed onto a spray-dried basic powder which contains phosphates and the spray-dried pal particles thus treated are processed with such substances as carbonate.

Spray-dried carrier particles aftertreated with nonionic surfactants are known, for example, from European patent application EP-A-0 149 264 and from German patent applications DE-A-34 44 960, DE-A-35 45 947 and DE-A-39 36 405.

Unfortunately, the described process variants lead to powders which either show favorable dispensing behavior or favorable dissolving behavior or which exhibit neither favorable dissolving behavior nor favorable dispensing behavior.

Accordingly, the problem addressed by the present invention was to provide a spray-dried detergent which would show both favorable dispensing behavior and favorable dissolving behavior.

DESCRIPTION OF THE INVENTION

In a first embodiment, therefore, the present invention relates to a spray-dried detergent or a component therefor containing anionic surfactants, inorganic builders and other ingredients of detergents, the detergent containing a) 3 to 20% by weight of anionic surfactants, b) 0 to 2% by weight of nonionic surfactants, c) 20 to 65% by weight of inorganic builders (based on water-free active substance) from the group of carbonates, hydrogen carbonates and silicate-containing builders, d) 0 to 25% by weight of neutral salts, e) other typical ingredients in the spray-dried particles, with the proviso that the spray-dried particles are aftertreated with nonionic surfactants.

The quantities a) to e) are based on the non-aftertreated spray-dried particles unless otherwise stated in the specification.

Surprisingly, excellent dispensing and dissolving properties are obtained for spray-dried components of the type in question although they are aftertreated solely with nonionic surfactants and not—as described in EP-A-0360 330—with mixtures of nonionic surfactants and fatty acids.

In one particular embodiment, the present invention relates to spray-dried detergents or components therefor in which the ratio by weight of the spray-dried particles to the nonionic surfactant is from 10:1 to 25:1 and, more particularly, from 12:1 to 20:1.

In another preferred embodiment of the present invention, the detergents contain at least one silicate-based builder, more particularly alumosilicates and/or amorphous sodium and/or potassium silicates, as the inorganic builder c). Advantageously, the detergents contain at least one silicate-based builder in combination with sodium and/or potassium carbonate.

Suitable alumosilicates are, in particular, finely crystalline, synthetic zeolites containing bound water, such as detergent-quality zeolite A. However, zeolite X and zeolite P and mixtures of zeolite A, X and/or P may also be used. The zeolite may be employed in the form of a spray-dried powder or even in the form of an undried, stabilized suspension still moist from its production. Where the zeolite is used in the form of a suspension, the suspension may contain small additions of nonionic surfactants as stabilizers, for example 1 to 3% by weight, based on the zeolite, of ethoxy-lated $C_{12-18}$ fatty alcohols containing 2 to 5 ethylene oxide groups, $C_{12-14}$ fatty alcohols containing 4 to 5 ethylene oxide groups or ethoxylated isotri-decanols. Suitable powder-form zeolites have a mean particle size of less than 10 $\mu$m (volume distribution, as measured by the Coulter Counter method) and preferably contain 18 to 22% by weight and, more preferably, 20 to 22% by weight of bound water.

Within the class of amorphous silicates, sodium silicates with a molar ratio of $Na_2O$ to $SiO_2$ of 1:1 to 1:4.5 and preferably 1:2 to 1:3.5 are most particularly suitable.

The content of alkali metal carbonates and/or hydrogen carbonates, more particularly sodium carbonates and/or sodium hydrogen carbonates, in the spray-dried particles is preferably 3 to 25% by weight and, more preferably, 10 to 25% by weight whereas amorphous silicates, more particularly sodium silicates with an $Na_2O$ to $SiO_2$ ratio of 1:2 to 1:3.5 are advantageously present in quantities of 0.5 to 7.5% by weight, based on the spray-dried particles.

The quantities of zeolite in the spray-dried particles may vary within wide limits. Preferred embodiments are both those which contain more than 30% by weight and, in particular, at least 35% by weight of zeolite (based on water-free active substance) and those which contain at most 30% by weight of zeolite (based on water-free active substance). In these two cases, other builders are preferably added during compounding to the spray-dried particles aftertreated with nonionic surfactants.

The spray-dried particles are aftertreated with nonionic surfactants by spraying the nonionic surfactants or an aqueous solution or dispersion of nonionic surfactants onto the spray-dried particles. The spraying on process may be carried out once, several times or continuously, for example on conveyor belts. In a preferred procedure, the nonionic surfactants are mixed with the spray-dried particles in a mixer or the nonionic surfactants are sprayed onto the spray-dried particles in a mixer. At the same time, the particles may be compacted in the mixer so that their apparent density is increased.

The nonionic surfactants used in the aftertreatment are preferably alkoxylated, advantageously ethoxylated, more particularly primary alcohols preferably containing 8 to 18 carbon atoms and an average of 1 to 12 moles of ethylene oxide (EO) per mole of alcohol, in which the alcohol radical may be linear or, preferably, 2-methyl-branched or may contain linear and methyl-branched radicals in the form of the mixtures typically present in oxoalcohol radicals. However, alcohol ethoxylates containing linear radicals of alcohols of native origin with 12 to 18 carbon atoms, for example coconut oil fatty alcohol, palm oil fatty alcohol, tallow fatty alcohol or oleyl alcohol, and an average of 2 to 8 EO per mole of alcohol are particularly preferred. Preferred ethoxylated alcohols include, for example, $C_{12-14}$ alcohols containing 3 EO or 4 EO, $C_{9-11}$ alcohols containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned are statistical mean values which, for a special product, may be either a whole number or a broken number. Preferred alcohol ethoxylates have a narrow homolog distribution (narrow range ethoxylates, NRE). In addition to these nonionic surfactants, fatty alcohols containing more than 12 EO may also be used. Examples of such fatty alcohols are tallow fatty alcohol containing 14 EO, 25 EO,30EO or40EO.

In addition, alkyl glycosides corresponding to the general formula $RO(G)_x$ may be used as further nonionic surfactants. In this general formula, R is a primary linear or methyl-branched, more particularly 2-methyl-branched, aliphatic radical containing 8 to 22 and preferably 12 to 18 carbon atoms and G is a glycose unit containing 5 or 6 carbon atoms, preferably glucose. The degree of oligomerization x, which indicates the distribution of monoglycosides and oligoglycosides, is a number of 1 to 10 and preferably assumes a value of 1.1 to 1.4.

Nonionic surfactants of the amine oxide type, for example N-cocoalkyl-N,N-dimethyl amine oxide and N-tallow alkyl-N,N-dihydroxyethyl amine oxide, and the fatty acid alkanolamide type are also suitable. The quantity in which these nonionic surfactants are used is preferably no greater than and, in particular, no more than half the quantity in which the ethoxylated alcohols are used.

Other suitable surfactants are polyhydroxyfatty acid amides which are normally obtained by reductive amination of a reducing sugar with ammonia, an alkylamine or an alkanolamine and subsequent acylation with a fatty acid, a fatty acid alkyl ester or a fatty acid chloride. The polyhydroxyfatty acid amides are preferably derived from reducing sugars containing 5 or 6 carbon atoms, more particularly from glucose.

The spray-dried particles themselves should contain no more than 2% by weight of nonionic surfactants. In a preferred embodiment, the spray-dried particles even contain a maximum of only 1% by weight of nonionic surfactants before their aftertreatment. In a preferred variant of this embodiment, the nonionic surfactants are not separately added to the slurry, but are merely introduced into the slurry to be spray-dried through raw materials in which they are used, for example, as stabilizers. In this case, too, suitable nonionic surfactants are above all the alkoxylated, preferably ethoxylated, alcohols and fatty alcohols and also alkyl glycosides and polyhydroxyfatty acid amides.

The particles to be spray-dried contain anionic surfactants in quantities of 3 to 20% by weight and preferably in quantities of 5 to 15% by weight. The anionic surfactants used are, in particular, anionic surfactants of the sulfonate and sulfate types. Preferred surfactants of the sulfonate type are $C_{9-13}$ alkyl benzene sulfonates, olefin sulfonates, i.e. mixtures of alkene and hydroxy-alkane sulfonates, and the disulfonates obtained, for example, from $C_{12-18}$ monoolefins with a terminal or internal double bond by sulfonation with gaseous sulfur trioxide and subsequent alkaline or acidic hydrolysis of the sulfonation products. Other suitable surfactants of the sulfonate type are alkane sulfonates obtained from $C_{12-18}$ alkanes, for example by sulfochlorination or sulfoxidation and subsequent hydrolysis or neutralization.

Also suitable are the esters of α-sulfofatty acids (ester sulfonates), for example a-sulfonated methyl esters of hydrogenated coconut oil, palm kernel oil or tallow fatty acids, and the α-sulfofatty acids obtainable therefrom by ester cleavage and disalts thereof.

Other suitable anionic surfactants are sulfonated fatty acid glycerol esters. Fatty acid glycerol esters are understood to be the mono-, di- and triesters and the mixtures thereof obtained where production is carried out by esterification of a monoglycerol with 1 to 3 moles of fatty acid or in the transesterification of triglycerides with 0.3 to 2 moles of glycerol. Preferred sulfonated fatty acid glycerol esters are the sulfonation products of saturated fatty acids containing 6 to 22 carbon atoms, for example caproic acid, caprylic acid, capric acid, myristic acid, lauric acid, palmitic acid, stearic acid or behenic acid. If fats and oils, i.e. natural mixtures of different fatty acid glycerol esters, are used as the starting material, the products used have to be largely saturated with hydrogen in known manner before sulfonation. Typical examples of suitable starting materials are palm oil, palm kernel oil, palm stearin, olive oil, rapeseed oil, coriander oil, sunflower oil, cottonseed oil, peanut oil, linseed oil, lard oil or lard. The sulfonation products are a complex mixture containing mono-, di- and triglyceride sulfonates with a sulfonic acid group in the α-position and/or an internal sulfonic acid group. Sulfonated fatty acid salts, glyceride sulfates, glycerol sulfates, glycerol and soaps are formed as secondary products. If saturated fatty acids or hydrogenated fatty acid glycerol ester mixtures are used as starting materials for the sulfonation process, the percentage content of α-sulfonated fatty acid disalts may readily be up to about 60% by weight, depending on how the process is carried out.

Suitable surfactants of the sulfate type are the sulfuric acid monoesters of primary alcohols of natural and synthetic origin. Preferred alk(en)yl sulfates are the alkali metal salts and, in particular, the sodium salts of the sulfuric acid semiesters of $C_{12-18}$ fatty alcohols, for example coconut oil fatty alcohol, tallow fatty alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{16-18}$ alk(en)yl sulfates are particularly preferred from the point of view of washing technology. It can also be of particular advantage, especially for machine detergents, to use $C_{16-18}$ alk(en)yl sulfates in combination with relatively low-melting anionic surfactants and, in particular, with anionic surfactants which have a lower Krafft point and which have a lower tendency to crystallize at relatively low washing temperatures, for example from room temperature to 40° C. In one preferred embodiment of the invention, therefore, the detergents contain mixtures of short-chain and long-chain fatty alkyl sulfates, preferably mixtures of $C_{12-14}$ fatty alkyl sulfates or $C_{12-18}$ fatty alkyl sulfates with $C_{16-18}$ fatty alkyl sulfates and, more particularly, $C_{12-16}$ fatty alkyl sulfates with $C_{16-18}$ fatty alkyl sulfates. However, another preferred embodiment of the invention is characterized by the use of unsaturated alkyl sulfates with an alkenyl chain length of preferably $C_{16}$ to $C_{22}$ in addition to saturated alkyl sulfates. In this embodiment, mixtures of saturated sulfonated fatty alcohols consisting predominantly of $C_{16}$ and unsaturated, sulfonated fatty alcohols consisting predominantly of $C_{18}$, for example those derived from solid or liquid fatty alcohol mixtures of the HD-Ocenol® type (a product of Henkel KGaA), are particularly preferred. Ratios by weight of alkyl sulfates to alkenyl sulfates of 10:1 to 1:2 are preferred, ratios by weight of about 5:1 to 1:1 being particularly preferred.

Sulfuric acid monoesters of linear or branched $C_{7-21}$ alcohols ethoxylated with 1 to 6 moles of ethylene oxide, such as 2-methyl-branched $C_{9-11}$ alcohols containing on average 3.5 moles of EO or $C_{12-18}$ fatty alcohols containing 1 to 4 EO, are also suitable. In view of their high foaming capacity, they are used in only relatively small quantities, for example of 1 to 5% by weight, in detergents.

Other preferred anionic surfactants are the salts of alkyl sulfosuccinic acid which are also known as sulfosuccinates or as sulfosuccinic acid esters and which represent the monoesters and/or diesters of sulfosuccinic acid with alcohols, preferably fatty alcohols and, more particularly, ethoxylated fatty alcohols. Preferred sulfosuccinates contain $C_{8-18}$ fatty alcohol radicals or mixtures thereof. Particularly preferred sulfosuccinates contain a fatty alcohol radical derived from fatty alcohols which, regarded in isolation, represent nonionic surfactants. Of these, sulfosuccinates of which the fatty alcohol radicals are derived from ethoxylated fatty alcohols with a narrow homolog distribution are particularly preferred. Alk(en)yl succinic acid preferably containing 8 to 18 carbon atoms in the alk(en)yl chain or salts thereof may also be used.

Preferred anionic surfactant mixtures contain combinations with alk(en)yl sulfates, more particularly combinations of alk(en)yl sulfates and alkyl benzene sulfonates.

The anionic surfactants may be present in the form of their sodium, potassium or ammonium salts and also as soluble salts of organic bases, such as mono-, di-or triethanolamine. The anionic surfactants are preferably present in the form of their sodium or potassium salts, more particularly in the form of their sodium salts.

In addition to the anionic surfactants, the detergents may also contain soaps, preferably in quantities of at most 5% by weight and, more preferably, in quantities of 0.5 to 3% by weight. Suitable soaps are, in particular, saturated fatty acid soaps, such as the salts of lauric acid, myristic acid, palmitic acid, stearic acid, hydrogenated erucic acid and behenic acid, and soap mixtures derived in particular from natural fatty acids, for example coconut oil, palm kernel oil or tallow fatty acids. Like the anionic surfactants, the soaps are preferably present in the form of their sodium or potassium salts and, more preferably, in the form of their sodium salts.

Preferred neutral salts include the sodium sulfates and/or potassium sulfates which, as already known, may be used with advantage in spray-drying processes. These neutral salts and, more particularly, sodium sulfate are preferably used in quantities of 5 to 25% by weight.

The aftertreated spray-dried detergents may also contain organic builders as further constituents. Organic builders include, for example, polycarboxylic acids or salts thereof, such as citric acid, adipic acid, succinic acid, glutaric acid, tartaric acid, sugar acids, aminocarboxylic acids, nitrilotriacetic acid (NTA), providing its use is not objectionable on ecological grounds, and mixtures thereof. The use of sugar acids in particular can lead to a reduction in the viscosity of the slurry and to an increase in apparent density.

Suitable polymeric polycarboxylates are, for example, the sodium salts of polyacrylic acid or polymethacrylic acid, for example those having a relative molecular weight of 800 to 150,000 (based on acid). Suitable copolymeric polycarboxylates are, in particular, those of acrylic acid with methacrylic acid and those of acrylic acid or methacrylic acid with maleic acid. Acrylic acid/maleic acid copolymers containing 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000. Terpolymers are also particularly preferred, for example those which contain salts of acrylic acid and maleic acid and also vinyl alcohol or vinyl alcohol derivatives as monomers (DE-A-43 00 772) or those which contain salts of acrylic acid and 2-alkyl allyl sulfonic acid and sugar derivatives as monomers (DE-C-42 21 381). Other preferred copolymers are the copolymers which are described in German patent applications DE 43 03 320 and P 44 17 734.8 and which preferably contain acrolein and acrylic acid or acrylic acid salts or vinyl acetate as monomers.

Other suitable builder systems are the oxidation products of carboxy-functional polyglucosans and/or water-soluble salts thereof which are described, for example, in International patent application WO-A-93108251 or of which the production is described, for example, in International patent application WO-A-93/161 10.

Other preferred builders are the known polyaspartic acids and salts and derivatives thereof. Polyacetals obtained by reaction of dialdehydes with polyol carboxylic acids containing 5 to 7 carbon atoms and at least three hydroxyl groups, for example as described in European patent application EP-A-0 280 223, are also suitable builders. Preferred polyacetals are obtained from dialdehydes, such as glyoxal, glutaraldehyde, terephthalaldehyde and mixtures thereof, and from polyol carboxylic acids, such as gluconic acid and/or glucoheptonic acid.

The content of organic builders in the spray-dried detergents is generally from 0.5 to 10% by weight and preferably from 2 to 8% by weight.

In addition, the detergents may also contain components with a positive effect on the removability of oil and fats from textiles by washing. This effect becomes particularly clear when a textile which has already been repeatedly washed with a detergent according to the invention containing this oil-and fat-dissolving component is soiled. Preferred oil-and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof.

The detergents may additionally contain components which improve solubility. Examples of such constituents are polyethylene glycols with a relative molecular weight of 200 to 4,000, preferably up to 2,000, fatty alcohols containing 20 to 80 moles of EO per mole of fatty alcohol, for example tallow fatty alcohol containing 30 EO and tallow fatty alcohol containing 40 EO, and the fatty alcohol containing 14 EO mentioned above in connection with the nonionic surfactants.

In addition, the spray-dried detergents may contain typical foam inhibitors. Suitable foam inhibitors are, for example, soaps of natural or synthetic origin with a high percentage content of $C_{18-24}$ fatty acids. Suitable non-surface-active foam inhibitors are, for example, organopolysiloxanes and mixtures thereof with microfine, optionally silanized silica and also paraffins, waxes, microcrystalline waxes and mixtures thereof with silanized silica or bis-stearyl ethylenediamide. Mixtures of various foam inhibitors, for example mixtures of silicones, paraffins or waxes, are also used with advantage.

Preferred salts of polyphosphonic acids are the neutrally reacting sodium salts of, for example, 1-hydroxyethane-1, 1-diphosphonate, diethylenetriamine pentamethylene phosphonate or ethylenediamine tetramethylene phosphonate which are used in quantities of 0.1 to 1.5% by weight.

Other suitable components are, for example, redeposition inhibitors of which the function is to keep the soil detached from the fibers suspended in the wash liquor and thus to prevent discoloration. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used.

Polyvinyl pyrrolidone is also suitable. However, cellulose ethers, such as carboxymethyl cellulose (Na salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone may also be used, for example in quantities of 0.1 to 5% by weight.

The detergents may also contain optical brighteners, for example derivatives of diaminostilbene disulfonic acid or alkali metal salts thereof. Suitable optical brighteners are, for example, salts of 4,4'-bis-(2-anilino-4-morpholino-1,3, 5-triazinyl-6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned above may also be used.

The content of components e) in the spray-dried particles is preferably less than 30% by weight and more preferably less than 25% by weight.

The aftertreated spray-dried granules are distinguished by excellent dispensing behavior and by excellent dissolving behavior. To determine dispensing behavior, conditions corresponding to the dispensing compartment of a domestic dishwashing machine operated under critical conditions are simulated. Quantities of 100 g of product are introduced into the test dispenser (Zanussi dispensing chute) and, after an interval of 1 minute, 10 liters of tap water are introduced over a period of 80 seconds. The quantity of residue remaining after this time is preferably less than 5 g and, more preferably, less than 2 g for the spray-dried detergents aftertreated in accordance with the invention.

To determine dissolving behavior, residues are simulated on dark textiles in two different tests. In the first test, 30 liters of tap water are first run into a tub-type washing machine (of the Arcelik or comparable type), after which 5.4 g/l of the detergent are added and dissolved by stirring. The machine is then loaded with the washing consisting of various dark-colored easy-care delicates of wool, cotton, polyamide and polyacrylonitrile and heated to a temperature of 30° C. After this temperature has been reached, the washing is washed for 10 minutes by actuating the agitator, after which the wash liquor is drained off, the washing is rinsed three times with 30 liters of water and then spun for 15 seconds. The washing is dried in an infrared dryer and evaluated by five experienced examiners on the following scale (average values):

Score 1: satisfactory, no discernible residues

Score 2: acceptable, isolated non-problematical residues

Score 3: discernible residues regarded as problematical on critical evaluation

Score 4 and higher: clearly discernible and problematical residues in increasing quantities The aftertreated spray-dried detergents are preferably given scores below 4.

In a second test, hand washing and the dissolving rate of a detergent important to machine washing are simulated.

To this end, 8 g of the detergent to be tested are introduced with stirring into a 2 liter glass beaker (800 r.p.m. with a laboratory stirrer/propeller stirrer head centered 1.5 cm from the bottom of the glass beaker). The test is carried out in tap water with a hardness of 16° d. The wash liquor is then run off through a sieve. The glass beaker is rinsed out with a little cold water through the sieve. A double determination is carried out. The sieves are dried at 40° C. ±2° C. to constant weight in a drying cabinet. The detergent residue is weighed out. The residue is expressed as a percentage average value of the two individual determinations. If the individual results deviate from one another by more than 20%, further tests are carried out. The aftertreated spray-dried detergents preferably show residues of less than 10% and, more preferably, less than 5%.

In another particularly preferred embodiment, therefore, the present invention relates to aftertreated spray-dried detergents or components therefor which show residues in the described dispensing test of less than 2 g and preferably less than 1 g and a residue behavior in the tub washing machine with a score below 4 and, in the hand-washing test, of less than 5%.

In one preferred embodiment of the invention, the aftertreated spray-dried particles are compounded with other ingredients of detergents. In this embodiment, it is particularly preferred for a maximum of only 5% by weight of other nonionic surfactants, based on the final detergent, to be introduced in this way. The other ingredients, which are subsequently added to the aftertreated spray-dried particles, are in particular those which are sensitive to heat and/or water and which, accordingly, cannot be atomized without decomposing.

The added ingredients include in particular bleaching agents, such as peroxy bleaching agents and bleach activators, enzymes and enzyme stabilizers, dyes and fragrances, opacifiers and pearlescers and, optionally, foam inhibitors, more particularly silicone-and/or paraffin-containing foam inhibitors, which are fixed to a granular water-soluble or water-dispersible support.

Among the compounds yielding $H_2O_2$ in water which are used as bleaching agents, sodium perborate tetrahydrate and sodium perborate monohydrate are of particular importance. Other bleaching agents are, for example, sodium percarbonate, peroxypyrophosphates, citrate perhydrates and $H_2O_2$-yielding peracidic salts or peracids, such as perbenzoates, peroxophthalates, diperazelaic acid or diperdodecanedioic acid. The content of bleaching agents in the detergents is preferably 5 to 25% by weight and, more preferably, 10 to 20% by weight, based on the final detergent.

In order to obtain an improved bleaching effect where washing is carried out at temperatures of 60° C. or lower, bleach activators may be incorporated in the formulations. Examples of bleach activators are N-acyl or O-acyl compounds which form organic peracids with $H_2O_2$, preferably N,N'-tetraacylated diamines, p-(alkanoyloxy)-benzene sulfonates, carboxylic anhydrides and esters of polyols, such as glucose pentaacetate. Other known bleach activators are acetylated mixtures of sorbitol and mannitol of the type described, for example, in European patent application EP-A-0 525 239. The content of bleach activators in the bleach-containing detergents is in the usual range, preferably from 1 to 10% by weight and more preferably from 3 to 8% by weight, again based on the final detergent. Particularly preferred bleach activators are N,N,N'N'-tetraacetyl ethylenediamine (TAED), 1,5-diacetyl-2,4-dioxohexahydro-1,3,5-triazine (DADHT) and acetylated sorbitol/mannitol mixtures (SORMAN).

Suitable enzymes are those from the class of proteases, lipases or lipolytic enzymes, for example cutinases, amylases, cellulases or mixtures thereof. Enyzmes obtained from bacterial strains or fungi, such as *Bacillus subtilis, Bacillus licheniformis, Streptomyces griseus* and *Humicola insolens*, are particularly suitable. Proteases of the subtilisin type are preferred, proteases obtained from *Bacillus lentus* being particularly preferred. Enzyme mixtures, for example of protease and amylase or protease and lipase or lipolytic enzymes or protease and cellulase or of cellulase and lipase or lipolytic enzymes or of protease, amylase and lipase or lipolytic enzymes or of protease, lipase or lipolytic enzymes and cellulase, but especially protease- and/or lipase-containing mixtures or mixtures with lipolytic enzymes, are of particular interest. Peroxidases or oxidases may also be used. The enzymes may be adsorbed to supports and/or encapsulated in shell-forming substances to protect them against premature decomposition. The percentage content of the enzymes, enzyme mixtures or enzyme granules in the final detergent may be, for example, from about 0.1 to 5% by weight and is preferably from 0.1 to about 2% by weight.

Suitable stabilizers for per compounds and enzymes in particular are the above-mentioned salts of polyphosphonic acids. It is also possible to use proteases which are stabilized with soluble calcium salts and which have a calcium content of preferably around 1.2% by weight, based on the enzyme.

The other ingredients of detergents with which the after-treated spray-dried component may be compounded include other builders. In one preferred embodiment of the invention, however, these other builders are preferably zeolite-free. Preferred other builders include inorganic silicates, such as crystalline layer silicates, amorphous silicates or compounds of amorphous silicates and carbonates, and also organic builders, such as citric acid/citrate or Sokalan DCS®.

Preferred crystalline layer-form sodium silicates are those corresponding to the general formula $NaMSi_xO_{2x+1}.yH_2O$, where M is sodium or hydrogen, x is a number of 1.9 to 4 and y is a number of 0 to 20, preferred values for x being 2, 3 or 4. Corresponding crystalline layer silicates are described, for example, in European patent application EP-A-0 164 514. Preferred crystalline layer silicates corresponding to the above formula are those in which M stands for sodium and x assumes a value of 2 or 3.

The amorphous silicates or silicate-containing compounds may be produced by spray drying, granulation and/or compacting, preferably by roll compacting. Some of these silicates and carbonate-and silicate-containing granules are commercially available, for example as Britesil® from Akzo & Nobel, as Nabion 15® from Rhone-Poulenc, as Gransil® from Colin Stewart or as Dizzil® G from Akzo & Nobel.

These other builders are preferably used in quantities of 5 to 20% by weight, based on the detergent as a whole.

However, the content of the aftertreated spray-dried component in a correspondingly compounded detergent is at least 55% by weight of the detergent as a whole.

The dispensing behavior and the dissolving behavior or the residue behavior of the compounded detergent lie in the same preferred ranges as mentioned above for the after-treated spray-dried component.

By virtue of their physical properties, the detergents according to the invention may be introduced into the washing drum directly, for example using a dispensing aid, and indirectly via the dispensing compartment of commercial washing machines. Since the detergents according to the invention are detergents which exhibit both excellent dispensing behavior and excellent dissolving behavior, another embodiment of the invention relates to a process for washing white and/or colored textiles in which a detergent according to the invention or a component therefor is introduced via a dispenser provided for this purpose in a commercial washing machine.

EXAMPLES

Example 1

The detergent D1 according to the invention was obtained by after-treatment of 69.8 parts by weight of a spray-dried product P1 having the composition shown below with 4.5 parts by weight of a $C_{12-18}$ fatty alcohol containing 7 EO. A detergent C1 having the same composition as D1, but containing 64.5 parts by weight of a spray-dried and non-aftertreated product in admixture with 9.8 parts by weight of a compound of 83% by weight of sodium carbonate and 17% by weight of $C_{12-18}$ fatty alcohol containing 7 EO (the remaining nonionic surfactant was contained in the spray-dried product) and a detergent C2 likewise having the same composition as D1, but containing 54.6 parts by weight of a spray-dried and non-aftertreated product in admixture with 19.7 parts by weight of carrier particles impregnated with $C_{12-18}$ fatty alcohol containing 7 EO, which consisted of 54.6% by weight of zeolite A (water-free active substance), 1.5% by weight of tallow fatty alcohol containing 5 EO (as stabilizer), 2% by weight of a $C_{12-18}$ sodium fatty acid soap, 3.25% by weight of a copolymeric salt of acrylic acid and maleic acid, 22.8% by weight of $C_{12-18}$ fatty alcohol containing 7 EO and, for the rest, water, were produced for comparison purposes. Accordingly, the total quantity of $C_{12-18}$ fatty alcohol .7 EO in each of detergents D1, C1 and C2 was 6% by weight.

The dispensing behavior and solubility behavior (residue test) of all three detergents were measured both in a tub washing machine and in a simulated hand washing test, as described in the specification. Comparison Examples C3 and C4 were commercial products of competitors (see Table 1).

| Composition of | P1 in % by weight |
|---|---|
| $C_{9-13}$ alkyl benzene sulfonate (sodium salt) | 5.35 |
| $C_{16-18}$ tallow fatty alcohol sulfate (sodium salt) | 5.35 |
| $C_{12-18}$ fatty acid soap (sodium salt) | 2.15 |
| Sodium carbonate | 11.45 |
| Sodium sulfate | 9.05 |
| Zeolite (water-free active substance) | 41.1 |
| Copolymer of acrylic acid and maleic acid (sodium salt) | 4.3 |
| Amorphous sodium disilicate | 3.15 |
| Phosphonate | 0.5 |
| Water | 14.45 |
| Salts from solutions | Balance |

TABLE 1

| | Dispensing | Residue Behavior | |
|---|---|---|---|
| Detergent | Behavior Residue in g | In a Tub Washing Machine Score | In the Hand Washing Test in % |
| D1 | 0.1 | 3.5 | 1.5 |
| C1 | 3.3 | 4.0 | 15 |
| C2 | 17.5 | 2.9 | 5.1 |
| C3 | 18.5 | 5.8 | 3.3 |
| C4 | 5.1 | 3.4 | 14.9 |

Example 2

Two detergents D2 and D3 containing spray-dried components P2 and P3 were produced, 57.5 parts by weight of P2 and P3 first being aftertreated with 3.8 parts by weight of $C_{12-18}$ fatty alcohol containing 7 EO and C12-18 fatty alcohol containing 5 EO and then being compounded with 14.2 parts by weight of Nabion 15® (a product of Rhône-Poulenc) or a spray-dried soda/silicate compound of similar composition, 20 parts by weight of perborate tetrahydrate, 3 parts by weight of bleach activator (TAED), 1 part by weight of enzyme granules and 0.5 parts by weight of a granular foam inhibitor based on silicone oil.

The dispensing behavior and residue behavior of detergents D2 and D3 according to the invention were again measured in a tub washing machine and in a handwashing test (see Table 2). Detergent D2 did not leave any residue behind in the dispensing chute. The quantity of detergent used had been completely dispensed after only 8 liters of the throughflowing water.

| Compositions | P2 and P3 in % by weight | |
|---|---|---|
| $C_{9-13}$ alkyl benzene sulfonate (sodium salt) | 6.95 | 6.95 |
| $C_{16-18}$ tallow fatty alcohol sulfate (sodium salt) | 6.95 | 6.95 |
| $C_{12-18}$ fatty acid soap (sodium salt) | 2.6 | 2.6 |
| Sodium carbonate | 12.2 | 12.2 |
| Sodium sulfate | 16.1 | 22.45 |
| Zeolite (water-free active substance) | 28.35 | 28.35 |
| Copolymer of acrylic acid and maleic acid (sodium salt) | 6.9 | 6.9 |
| Amorphous sodium silicate ($Na_2O:SiO_2$ 1:3.3) | 5.2 | — |
| Phosphonate | 1.0 | 1.0 |
| Water | 11.4 | 10.2 |
| Salts from solutions | Balance | Balance |

The apparent density of detergents D1 to D3 and C1 to C2 was between 450 and 550 g/l.

TABLE 2

| | Dispensing | Residue Behavior | |
|---|---|---|---|
| Detergent | Behavior Residue in g | In a Tub Washing Machine Score | In the Hand Washing Test in % |
| D2 | — | 2.6 | 2.1 |
| D3 | 0.1 | 2.9 | 2.9 |

What is claimed is:

1. A spray-dried particulate detergent composition consisting of a) 3% to 20% by weight of synthetic anionic surfactant, b) 0 to 2% by weight of nonionic surfactant, c) 20% to 65% by weight of inorganic builders, based on water-free active substance, selected from the group consisting of alkali metal carbonates, alkali metal hydrogen carbonates, zeolites and mixtures thereof, and d) 5 to 25% by weight of neutral salts selected from the group consisting of sodium sulfate, potassium sulfate and mixtures thereof, based on the weight of said spray-dried composition, wherein said spray-dried composition has been aftertreated solely with a nonionic surfactant at a ratio by weight of said spray-dried composition to said nonionic surfactant of from 12:1 to 20.1.

2. A detergent composition as in claim 1 wherein the alkali metal carbonate or alkali metal hydrogen carbonate is present in amounts from 3% to 25% by weight, based on the weight of said composition.

3. A detergent composition as in claim 1 wherein more than 30% to 65% by weight of zeolite, based on water-free active substance is present in said composition.

4. A detergent composition as in claim 1 wherein at most 30% by weight of zeolite, based on water-free active substance is present in said composition.

5. A process of washing textiles comprising introducing into a washing machine via a dispenser a spray-dried particulate detergent composition consisting of a) 3% to 20% by weight of anionic surfactant, b) 0 to 2% by weight of nonionic surfactant, c) 20% to 65% by weight of inorganic builders, based on water-free active substance, selected from the group consisting of alkali metal carbonates, alkali metal hydrogen carbonates, zeolites and mixtures thereof, and d) 5 to 25% by weight of neutral salts selected from the group consisting of sodium sulfate, potassium sulfate and mixtures thereof, based on the weight of said spray-dried composition, wherein said spray-dried composition has been aftertreated solely with a nonionic surfactant at a ratio by weight of said spray-dried composition to said nonionic surfactant of from 12:1 to 20:1.

6. A process as in claim 5 wherein the alkali metal carbonate or alkali metal hydrogen carbonate, is present in amounts from 3% to 25% by weight, based on the weight of said composition.

7. A process as in claim 5 wherein more than 30% to 65% by weight of zeolite, based on water-free active substance is present in said composition.

* * * * *